US006394840B1

(12) United States Patent
Gassauer et al.

(10) Patent No.: US 6,394,840 B1
(45) Date of Patent: May 28, 2002

(54) CONTACT SECURING SLEEVE FOR USE WITH A COAXIAL CABLE

(75) Inventors: Uwe Gassauer, Erzhausen; Lothar Andreas Post, Offenbach; Horst Neumeuer, Bad Koenig; Dieter Lietz, Frankfurt, all of (DE)

(73) Assignee: The Whitaker Corporation, Wilmington, DE (US)

( * ) Notice: Subject to any disclaimer, the term of this patent is extended or adjusted under 35 U.S.C. 154(b) by 0 days.

(21) Appl. No.: 09/612,651

(22) Filed: Jul. 8, 2000

(30) Foreign Application Priority Data

Jul. 8, 1999 (EP) ..... 99113260

(51) Int. Cl.[7] ..... H01R 9/05; H01R 13/187
(52) U.S. Cl. ..... 439/584; 439/843
(58) Field of Search ..... 439/584, 843, 439/846, 578, 579, 580, 675, 905

(56) References Cited

U.S. PATENT DOCUMENTS 5,011,425 A * 4/1991 Van Zanten et al. ..... 439/353
5,129,023 A * 7/1992 Anderson et al. ..... 385/70
5,273,458 A 12/1993 Fisher, Jr. et al. ..... 439/585
6,039,614 A * 3/2000 Ramari ..... 439/843

* cited by examiner

*Primary Examiner*—Khiem Nguyen
*Assistant Examiner*—Chandrika Prasad

(57) ABSTRACT

An electrical connector for coaxial cable having at least one contact with a contact region for connection to a mating contact and a connection region for connection to a coaxial cable, wherein the contact includes a peripheral groove; a contact-securing sleeve can be pushed onto the contact from an end face that has at least one latching arm which latches in the groove and at least one further latching element; and a casing with at least one receiving chamber for receiving the contact with the contact-securing sleeve, wherein the latching element of the contact-securing sleeve latches with a mating latching element of the casing and the receiving chamber holds the latching arm in the latched position.

9 Claims, 10 Drawing Sheets

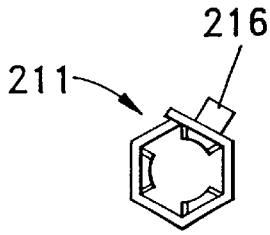
Fig. 21
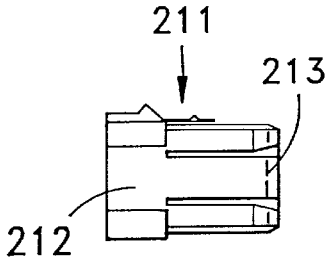
Fig. 19
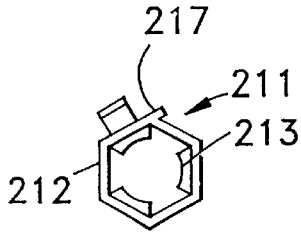
Fig. 20
Fig. 23
Fig. 24
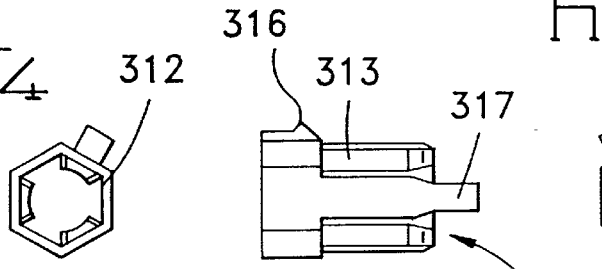
Fig. 22
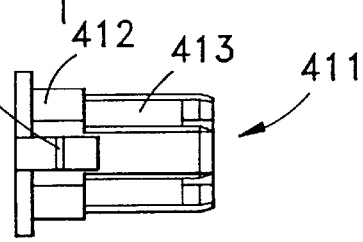
Fig. 25
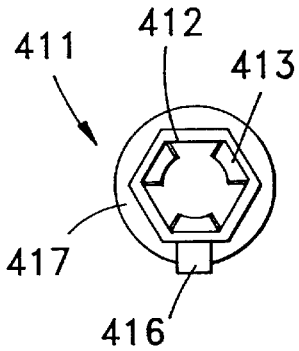
Fig. 29
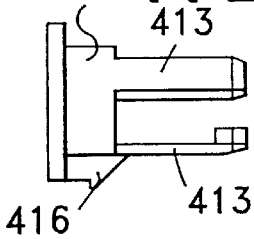
Fig. 26
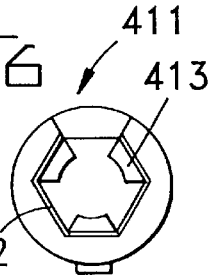
Fig. 28
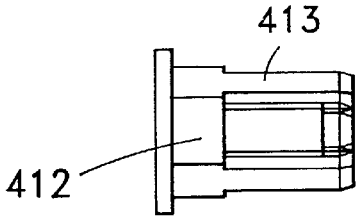
Fig. 27

Fig. 38
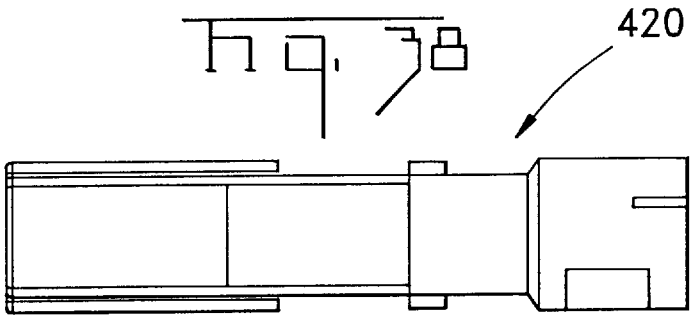
Fig. 39
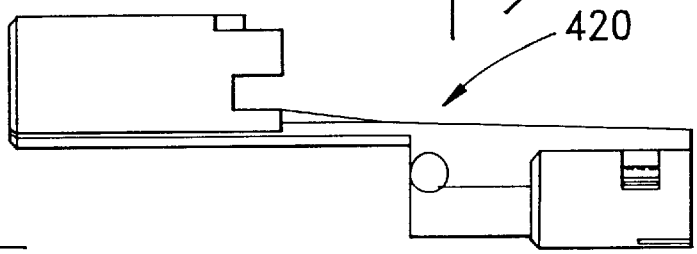
Fig. 42
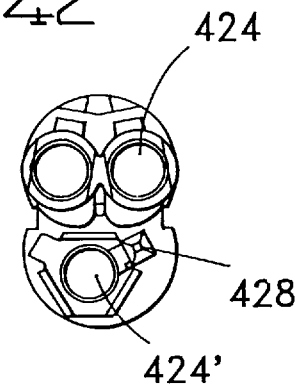
Fig. 41
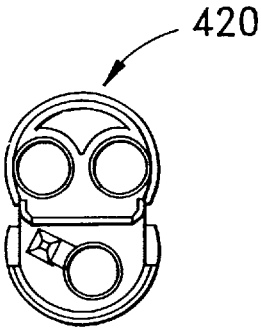
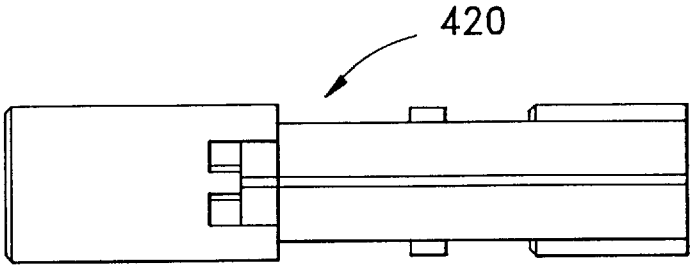
Fig. 40

CONTACT SECURING SLEEVE FOR USE WITH A COAXIAL CABLE

The invention relates to an electrical connector for coaxial cable.

DESCRIPTION OF THE PRIOR ART

Electrical connectors are used to connect electric cables detachably to one another at various transfer points. The electric cables are often designed for various functions and are accordingly different in construction. The connection points are provided, for example in automotive engineering, between different body parts which are assembled and which receive various electric cables.

Screw-in connectors are normally used for connecting high-quality coaxial cables. Coaxial cables are being used increasingly widely in automotive engineering, in particular to connect the transmitting and receiving modules to the aerials for GSM/GPS and/or RF aerials. The use of screw-in connectors is usually avoided in automotive engineering, as it is too expensive and it cannot be ensured that the screw connection will not loosen owing to the hard conditions and whether the mating connectors are completely plugged in.

SUMMARY OF THE INVENTION

It is accordingly an object of the invention to provide an electrical connector for coaxial cables which ensures that the connection between the coaxial cables is easy to plug in and secure.

The object is achieved by an electrical connector for coaxial cable comprising at least one contact with a contact region for connection to a mating contact and a connection region for connection to a coaxial cable, wherein the contact includes a peripheral groove; a contact-securing sleeve pushed onto the contact, having at least one latching arm which latches in the peripheral groove and at least one further latching element; and a casing having at least one receiving chamber for receiving the contact with the contact-securing sleeve thereupon, wherein the latching element of the contact-securing sleeve latches with a mating latching element of the casing and the receiving chamber holds the latching arm in the latched position.

A particular advantage is that two mating contacts for coaxial cable can be assembled by simply plugging in the corresponding connectors and they can be released again.

A further particular advantage is that a contact for a coaxial cable can easily be introduced into an electrical connector and can be securely held there. This is achieved through a contact-securing sleeve that is provided which can be pushed onto the contact and latched thereupon where the contact, with the contact-securing sleeve, is then also latched in a receiving chamber of the casing and the latching arms of the contact-securing sleeve are secured in the receiving chamber. The contact-securing sleeve can be pushed onto the contact from the end face, clipped on from the side or can be threaded on from behind. The contact for coaxial cable can be removed from the casing only when the latching between casing and contact-securing sleeve is released.

A further particular advantage is that secure application of the contact-securing sleeve onto the contact is ensured. This is effected in that the contact-securing sleeve latches audibly on the contact.

A further particular advantage is that the contact-securing sleeve cannot be pushed beyond its latched position onto the contact. This is prevented in that the groove, in which the latching projections of the contact-securing sleeve latch, has a shoulder with which the latching projections interact.

A further particular advantage is that the contact-securing sleeve comprises a plurality of latching arms which ensure a secure connection to the contact for coaxial cables.

A further particular advantage is that coding of the contacts via the contact-securing sleeve is possible. A further particular advantage is that coding of the casing is also permitted.

A particular advantage is that the contact system allows large tolerances in positioning. It is not necessary to provide latching and projecting elements on the contact itself, so a very small overall space can be achieved. Easy assembly, a simple production process and therefore low-cost connectors are achieved.

BRIEF DESCRIPTION OF THE DRAWINGS

FIG. 19 is a side view of a third embodiment of a contact-securing sleeve;

FIG. 20 is a corresponding back view of the contact-securing sleeve;

FIG. 21 is a view of the end face of the contact-securing sleeve;

FIG. 22 is a side view of a fourth embodiment of a contact-securing sleeve according to the invention;

FIG. 23 is a view of this contact-securing sleeve from the cable side;

FIG. 24 is an end view of this contact-securing sleeve from the end face;

FIG. 25 is a side view of a contact-securing sleeve of a fifth embodiment;

FIG. 26 is a further side view rotated through 90°;

FIG. 27 is yet a further side view rotated through 90°;

FIG. 28 is an end view of this contact-securing sleeve from the cable side;

FIG. 29 is an opposite end view of the contact-securing sleeve from the end face;

FIG. 38 is a side view of a casing suitable for receiving two contacts with contact-securing sleeve according to embodiments 1 or 2 and one contact with contact-securing sleeve according to embodiments 3 to 5;

FIG. 39 is a further side view of the casing;

FIG. 40 is a third side view of the casing;

FIG. 41 is an end view of the casing from the end face;

FIG. 42 is another end view of the casing from the cable side;

FIG. 43 is a perspective exploded view of a contact with a contact-securing sleeve;

FIG. 44 shows a perspective view of a contact with contact-securing sleeve applied;

FIG. 45 is an exploded view of this contact with contact-securing sleeve and casing;

FIG. 46 shows the casing with contact introduced;

FIG. 47 is an exploded view of a mating contact for a coaxial cable with contact-securing sleeve;

FIG. 48 shows the contact with contact-securing sleeve applied;

DETAILED DESCRIPTION OF THE PREFERRED EMBODIMENT

Figure 1:
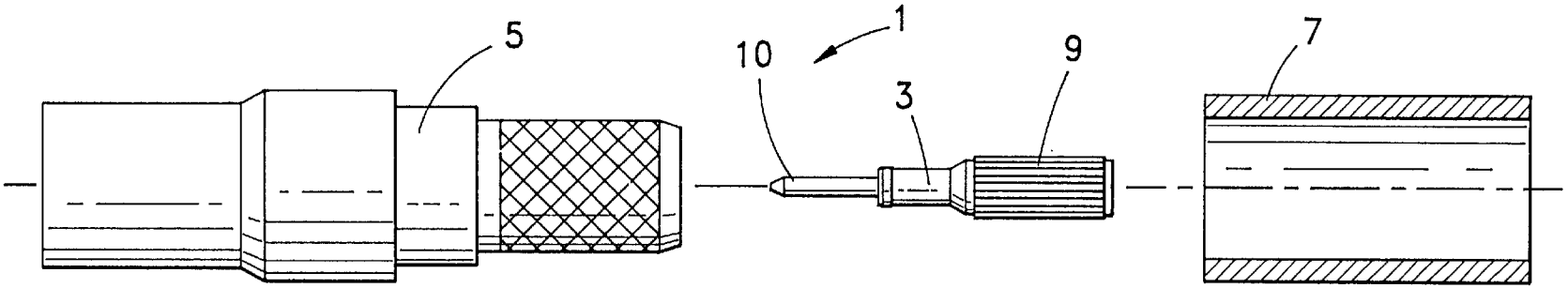
FIG. 1 shows the individual parts of a contact for coaxial cables.
Figure 2:
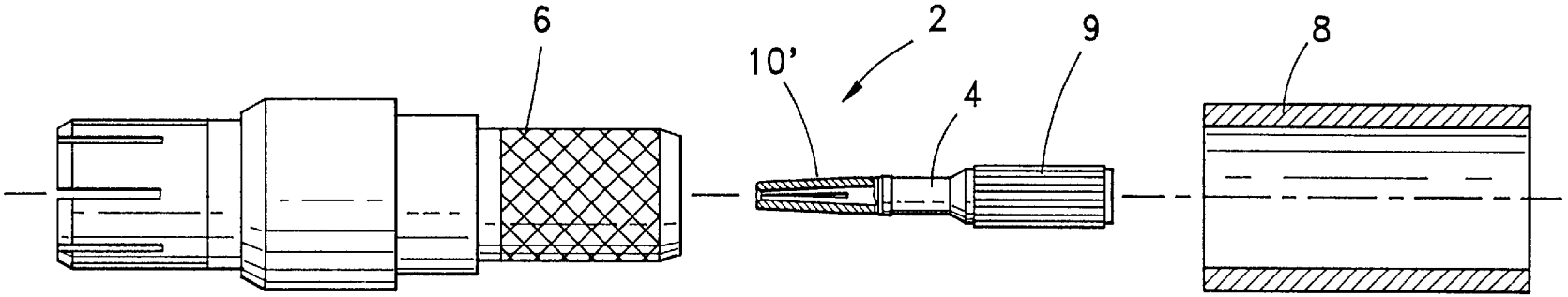
FIG. 2 shows the individual parts of a corresponding mating contact for coaxial cables.

FIGS. 1 and 2 show two mating contact assemblies 1, 2 for coaxial cables in detail. The contact assemblies 1, 2 each consist of a central part 3, 4 for contacting the central conductor of a coaxial cable and an external part 5, 6 for contacting the external conductor of the coaxial cable. The two contact assemblies 1, 2 also have a sleeve 7, 8 that is used for fastening on the coaxial cable.

The central part 3, 4 has a respective crimped region 9 for fastening on the cable as well as a contact region 10, 10' which is designed either as contact pin 10 or as contact socket 10'. The external part 5, 6 comprises a respective insulator region and a contact region for contacting the external conductor. The external part 5, 6 is fastened on the cable by means of the sleeves 7, 8. The sleeves 7, 8 are crimped on the cable sheath for this purpose.

Figure 4:
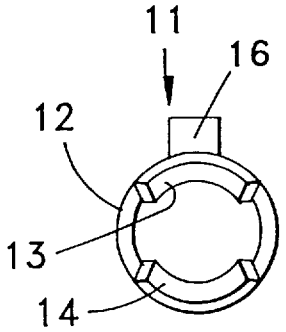
FIG. 4 is an end view of this contact-securing sleeve from the end face.
Figure 3:
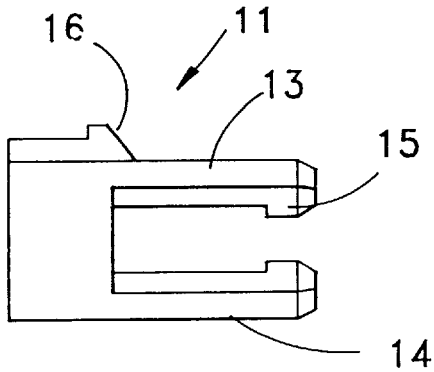
FIG. 3 is a side view of a first embodiment of a contact-securing sleeve.
Figure 5:
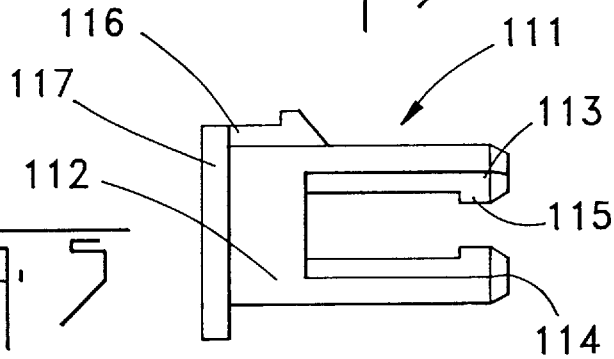
FIG. 5 is a side view of a second embodiment of a contact-securing sleeve.
Figure 7:
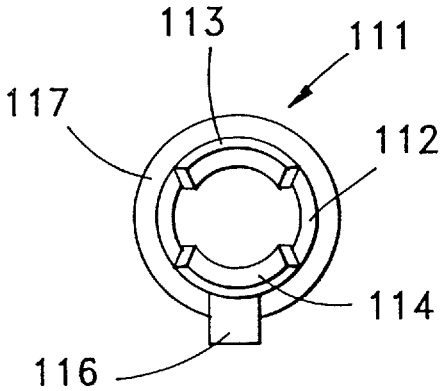
FIG. 7 is an end view of this contact-securing sleeve from the end face.
Figure 6:
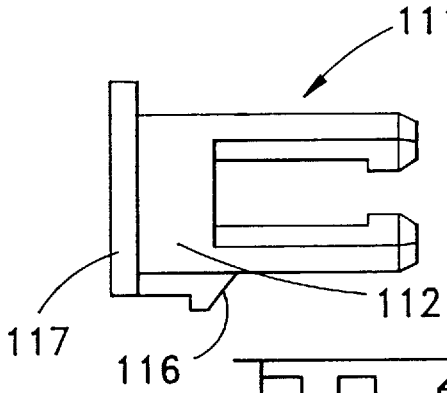
FIG. 6 is a further side view of this contact-securing sleeve.
Figure 8:
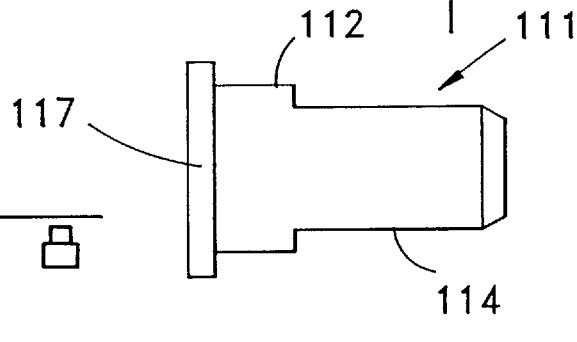
FIG. 8 is a side view of the contact-securing sleeve.
Figure 9:
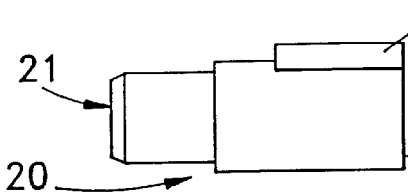
FIG. 9 is a side view of a casing suitable for receiving the contact-securing sleeves according to the foregoing embodiments.
Figure 11:
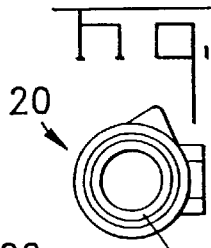
FIG. 11 is an end view of the casing from the end face.
Figure 12:
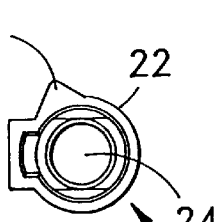
FIG. 12 is an opposite end view of the casing from the cable side.
Figure 10:
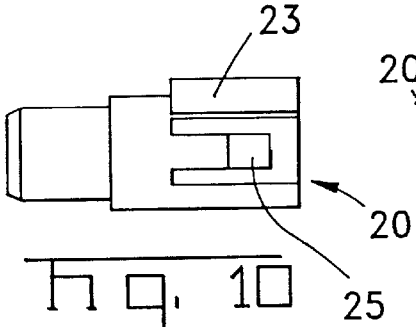
FIG. 10 is a corresponding further side view of the casing.

FIGS. 3 and 4 show a first embodiment of a contact-securing sleeve 11. The contact-securing sleeve 11 consists of a ring 12 from which two opposing latching arms 13, 14 extend axially forwardly. The latching arms have a latching projection 15 at their free end and have a segment-shaped cross-section. The contact-securing sleeve 11 also has a further latching element in the form of a latching arm 16 at its ring end.

FIGS. 5 to 8 show a further embodiment of a contact-securing sleeve 111. This also has a closed ring 112 and two opposing latching arms 113 and 114 extending therefrom. The latching arms 113, 114 each comprise a latching projection 115. A further latching element 116 is also provided on the ring 112. The contact-securing sleeve according to the second embodiment differs from that of the first embodiment by a flange 117 which is arranged peripherally on the ring 112 at the end of the ring 112 opposite to the latching arms 113, 114. This flange 117 can be used, for example, as end stop or for coding.

Figure 13:
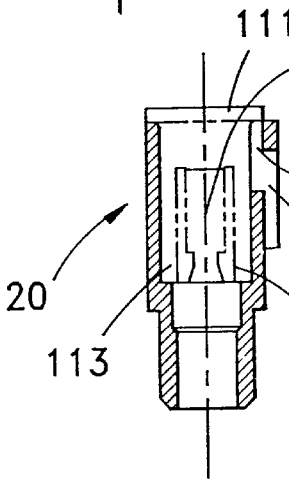
FIG. 13 is a cross-sectional side view of the casing with correspondingly indicated position of the contact-securing sleeve in this casing.
Figure 14:
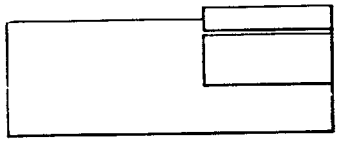
FIG. 14 is a side view of a second embodiment of a casing for receiving a contact-securing sleeve according to the first and second embodiment.
Figure 15:
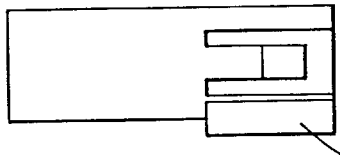
FIG. 15 is a further side view of the casing.
Figure 17:
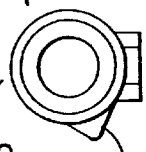
FIG. 17 is an end view of the casing from the end face.
Figure 16:
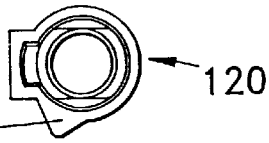
FIG. 16 is a back view of the casing.
Figure 18:
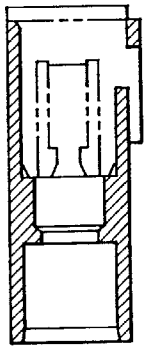
FIG. 18 is a cross-section of the casing with contact-securing sleeve indicated.
Figure 30:
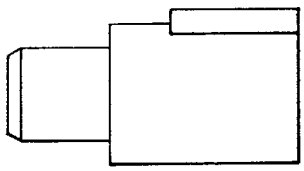
FIG. 30 is a side view of a casing suitable for receiving the contact-securing sleeves according to the third to fifth embodiments.
Figure 31:
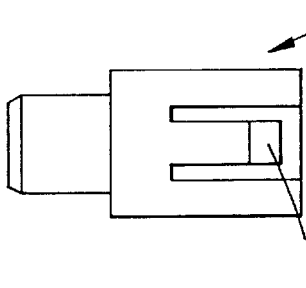
FIG. 31 is a corresponding further side view of the casing.
Figure 32:
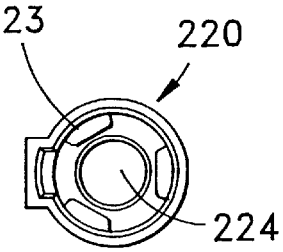
FIG. 32 is an end view of the casing from the cable side.
Figure 33:
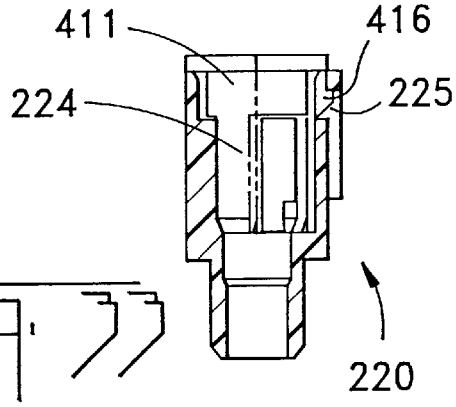
FIG. 33 is a cross-sectional side view through the casing with the contact-securing sleeve indicated.
Figure 34:
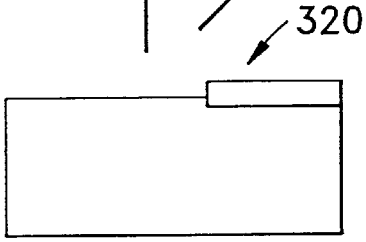
FIG. 34 shows a further embodiment of a casing for receiving the contact-securing sleeve according to embodiments 3 to 5.
Figure 35:
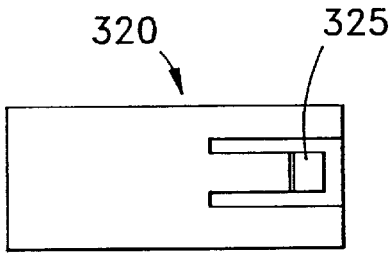
FIG. 35 is a further side view of this casing.
Figure 36:
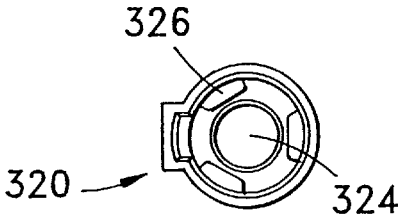
FIG. 36 is a view of this casing from the cable side.
Figure 37:
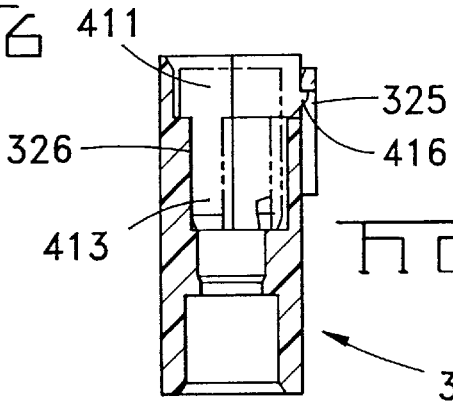
FIG. 37 is a cross-sectional side view through the casing with the position of the contact-securing sleeve indicated.
Figures 4A, 4B:
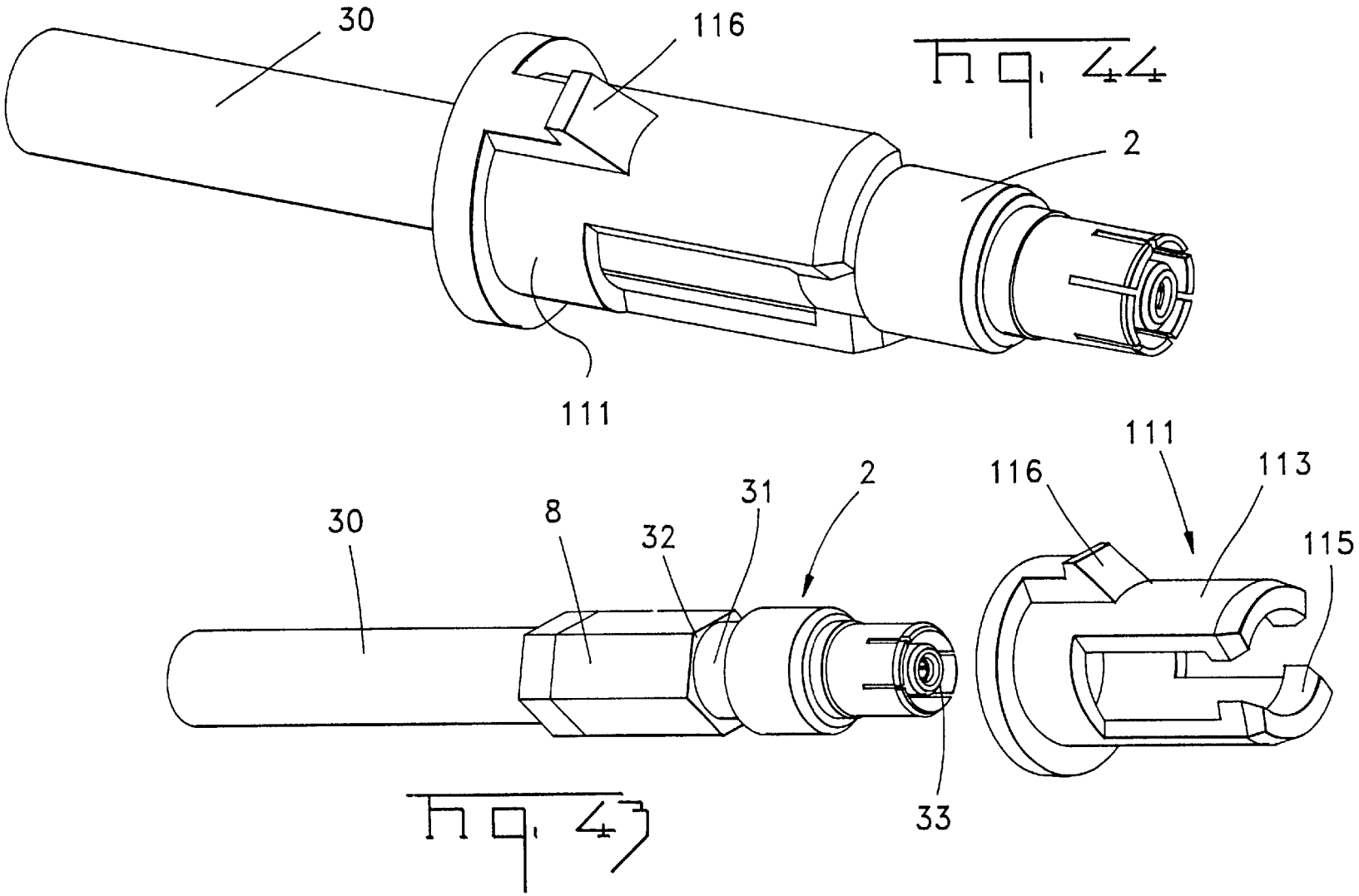
Figures 4A, 4B:
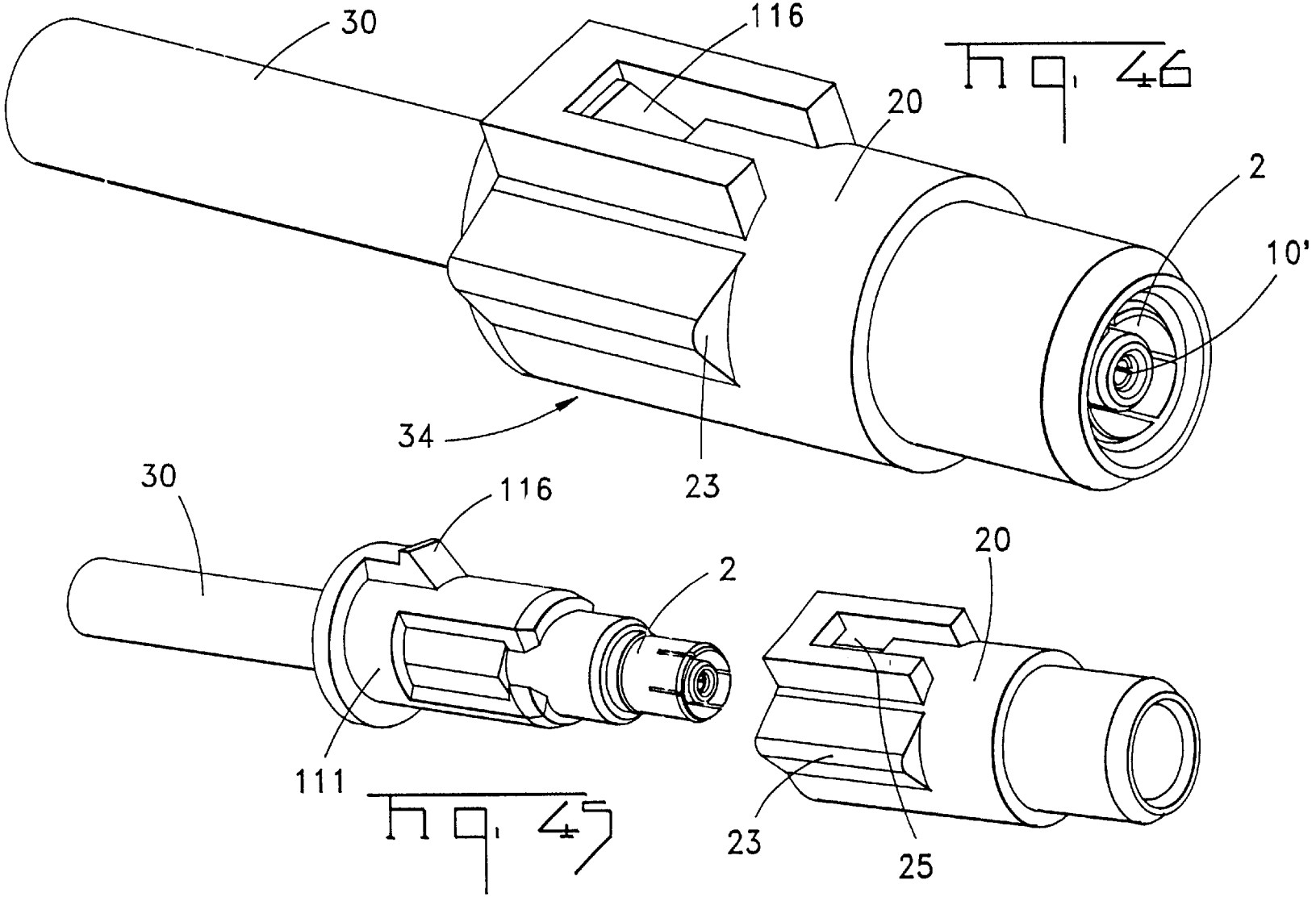
Figures 4A, 4B:
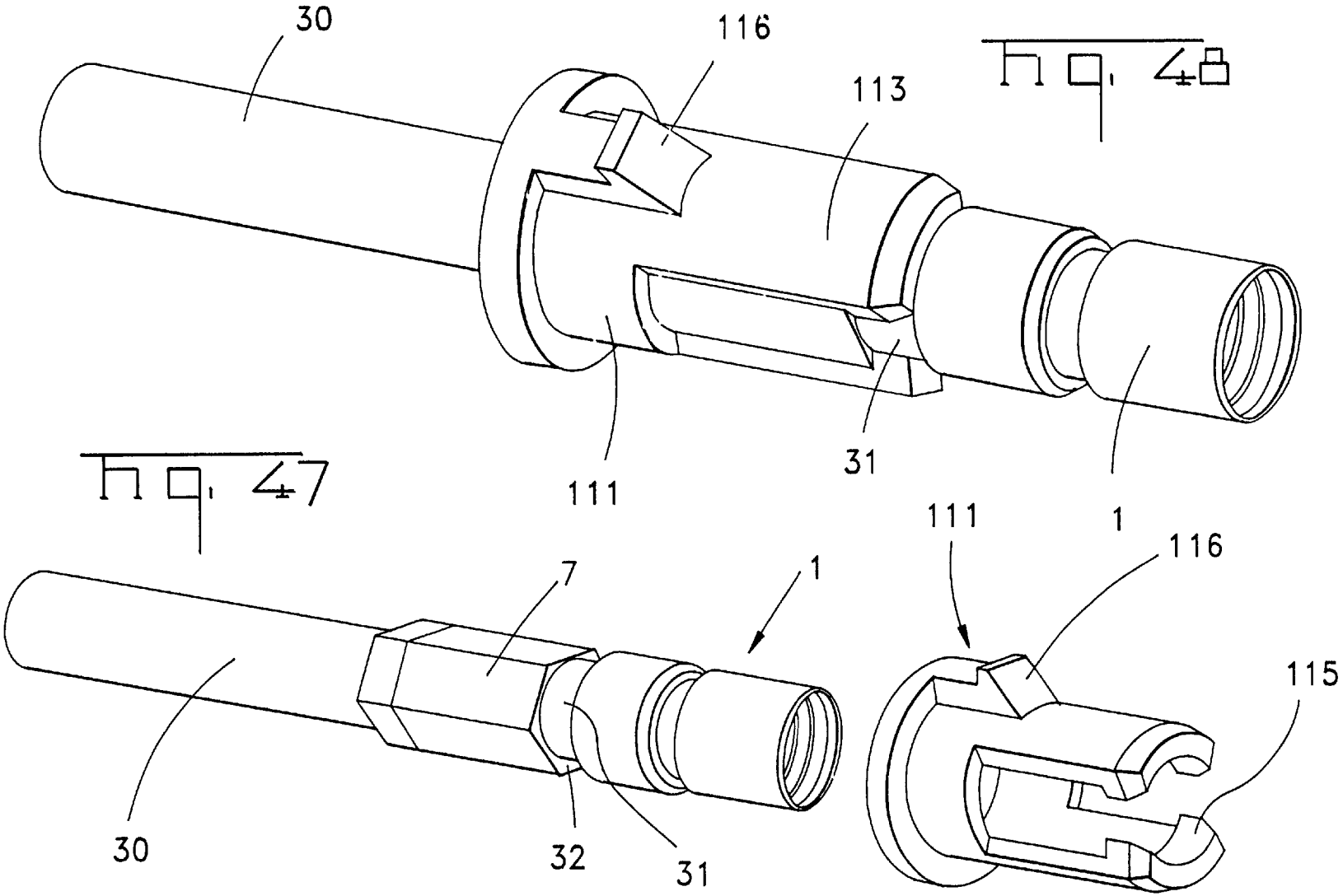

FIGS. 9 to 13 show a first embodiment of a casing 20 suitable for receiving a contact assembly with a contact-securing sleeve according to FIGS. 3 to 8. The casing 20 has a face end 21 and a cable end 22. The casing 20 is equipped with a coding rib 23 on the exterior. The casing 20 can be introduced into a corresponding housing. The casing 20 also has a receiving chamber 24 into which contact 1, 2 can be introduced with the contact-securing sleeve 11, 111. FIG. 13 is a schematic view of a contacting sleeve 111 of this type. The latching arms 113, 114 are fixed by the receiving chamber 24. The casing 20 also comprises a latching opening 25. This latching opening 25 interacts with the further latching element 116 of the contact-securing sleeve 111.

FIGS. 14 to 18 show a further embodiment of a casing 120 which differs from the embodiment according to FIGS. 8 to 13 only by the different position of the coding rib 123 and, as with the further embodiments, accordingly is numbered correspondingly.

FIGS. 19 to 23, 22 to 24 and 25 to 29 show three further embodiments of contact-securing sleeves 211, 311 and 411. These contact-securing sleeves differ from the former embodiments of contact-securing sleeves by two essential features. The first feature is that the contact-securing sleeves according to FIGS. 19 to 27 each have three latching arms distributed round their periphery. The second difference is that the contact-securing sleeves are not round but hexagonal in cross-section. The cross-section of the contact-securing sleeves is adapted to the cross-sectional shape of the contacts. The contact-securing sleeves according to FIGS. 19 to 27 each comprise a ring 212, 312, 412 which is hexagonal in cross-section and from which the latching arms 213, 313, 413 extend.

The three embodiments of the contact-securing sleeve 212, 312, 412 differ by different codings 217, 317, 417 which are designed as a rib 217 on the ring 212, as an extension 317 on one of the latching arms 313 or as a peripheral flange 417 on the ring 412. Each of the rings 212, 312, 412 carries a further latching element 216, 316, 416.

FIGS. 30 to 33 and 34 to 37 show two embodiments of casings 220, 320 suitable for receiving contact-securing sleeves according to FIGS. 19 to 29. The sections according to FIG. 33 and FIG. 37 each show a casing 320 or 220 with a contact-securing sleeve 414. The casings substantially correspond to the casing 20. A receiving chamber 224 and a latching opening 225 are provided. Three longitudinal ribs 226 or 326, between which the latching arms 413 of the contact-securing sleeve are received, are provided in the receiving chamber.

FIGS. 38 to 40 accordingly show a casing 420 comprising a plurality of receiving chambers 424, 424'. Whereas the receiving chambers 424 are designed to receive contacts with contact-securing sleeves corresponding to the first two embodiments, the chamber 424' is designed to receive a contact-securing sleeve according to FIGS. 25 to 29. A further chamber 428 is also provided into which a conventional electrical contact for an electric cable can be introduced, for example for the power supply.

FIG. 43 accordingly shows a coaxial cable 30 with an electrical contact 2. The contact 2 is rigidly connected to the coaxial cable and the sleeve 8 is crimped onto the cable. A contact-securing sleeve 111 is also shown. The electrical contact 2 comprises a peripheral groove 31 comprising a shoulder 32 directed toward the face end 33 of the contact. The contact-securing sleeve 111 is pushed over the contact from the face end thereof. The latching arms 113 are initially spread apart and then latch with the latching projections 115 in the groove 31. The contact 2 with the applied contact-securing sleeve 111 is accordingly introduced into a casing 20 until the latching element 116 latches in the latching opening 25. The corresponding electrical connector 34 is shown in FIG. 46.

Figure 50:
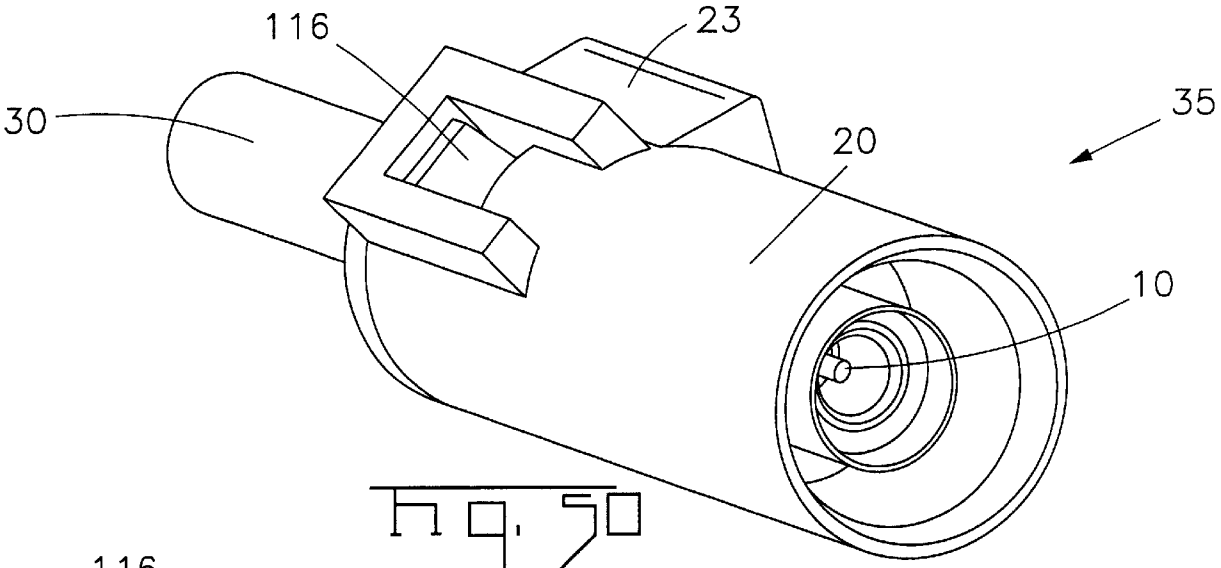
FIG. 50 shows the casing with the contact introduced.
Figure 49:
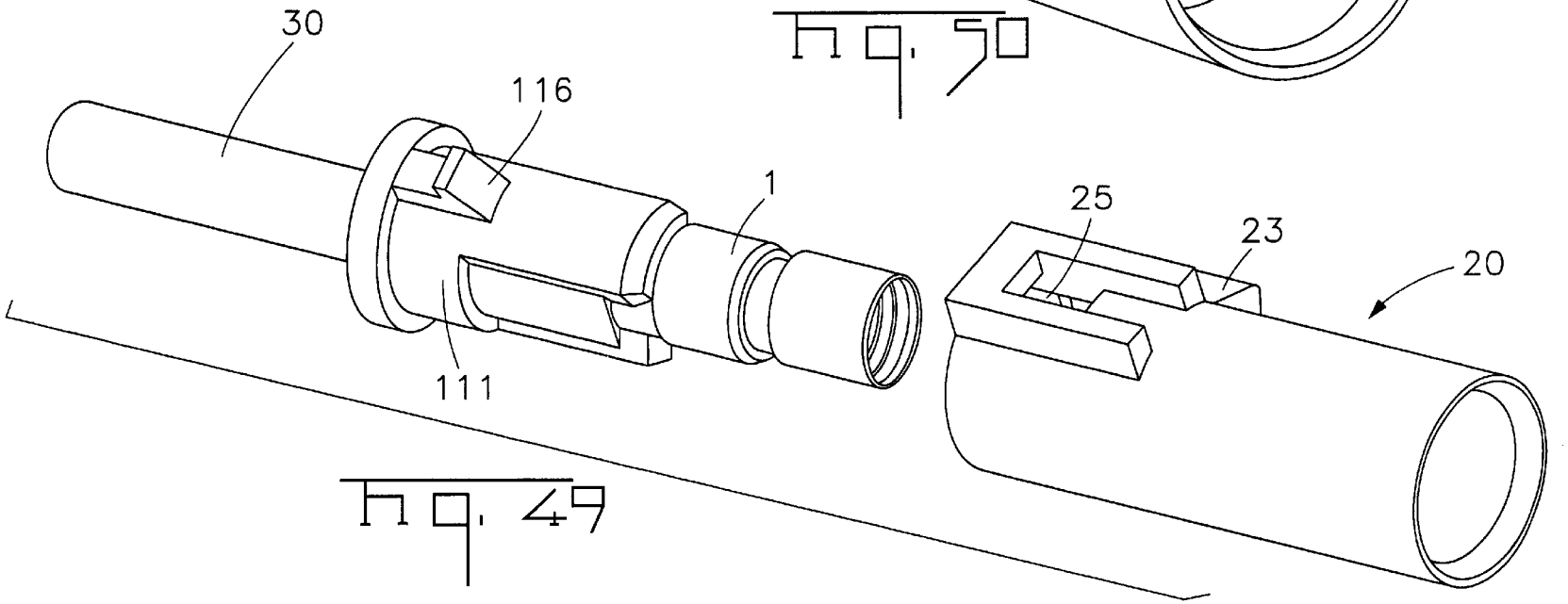
FIG. 49 is an exploded view of the contact with contact-securing sleeve applied and casing.

A corresponding arrangement for a mating contact 1 is shown in FIGS. 47 and 48. The complete mating electrical connector 35 is shown in FIG. 50. The respective latching arms of the contact-securing sleeve which are latched in the groove of the contact are fixed in the casings. The contact can be removed only if the latching between the contact-securing sleeve and the casing is opened.

We claim:

1. An electrical connector for coaxial cable comprising at least one contact for connection to a mating contact, the connector having a mating face at a first end and an opposed cable termination end for connection to a coaxial cable, wherein the contact includes a peripheral groove having a shoulder directed toward the mating face; a contact-securing sleeve pushed onto the contact, having at least one latching arm which latches in the peripheral groove and which cooperates with the shoulder to limit movement of the contact-securing sleeve away from the mating face, the contact-securing sleeve having at least one further latching element; and a casing having at least one receiving chamber for receiving the contact with the contact-securing sleeve thereupon, wherein the latching element of the contact-securing sleeve latches with a mating latching element of the casing and the receiving chamber holds the latching arm in the latched position.

2. The electrical connector according to claim 1, characterised in that the contact-securing sleeve comprises two mutually opposed latching arms.

3. The electrical connector according to claim 1, characterised in that the contact-securing sleeve comprises three peripherally distributed latching arms.

4. The electrical connector according to claim 2, characterised in that the contact-securing sleeve comprises a ring to which the latching arms and the latching element are attached.

5. The electrical connector according to claim 4, characterized in that the contact-securing sleeve can be pushed, ring first, over the contact.

6. The electrical connector according to claim 1, characterised in that the groove comprises a shoulder, orientated toward the end face of the contact, that interacts with a latching projection on the latching arm and prevents the contact-securing sleeve from being pushed further onto the coaxial cable.

7. The electrical connector according to claim 4, characterized in that the ring conforms to the shape of the contact.

8. The electrical connector according to claim 1, characterised in that the casing comprises a coding rib.

9. The electrical connector according to claim 1, characterised in that the contact-securing sleeve comprises coding elements.

* * * * *